US007597600B2

(12) United States Patent
Rui

(10) Patent No.: US 7,597,600 B2
(45) Date of Patent: Oct. 6, 2009

(54) ENGINE FOR DRIVING A WATERCRAFT PROPELLED BY A WATER JET

(75) Inventor: Yuting Rui, Ann Arbor, MI (US)

(73) Assignee: Surfango, Inc., Lakewood, NJ (US)

( * ) Notice: Subject to any disclaimer, the term of this patent is extended or adjusted under 35 U.S.C. 154(b) by 0 days.

(21) Appl. No.: 11/933,751

(22) Filed: Nov. 1, 2007

(65) Prior Publication Data

US 2009/0117789 A1 May 7, 2009

(51) Int. Cl.

| | |
|---|---|
| ***B63H 20/00*** | (2006.01) |
| ***F02B 75/20*** | (2006.01) |
| *B63H 21/10* | (2006.01) |
| *B63H 21/38* | (2006.01) |
| *B63H 11/00* | (2006.01) |
| *F01M 1/02* | (2006.01) |
| *F01M 9/10* | (2006.01) |
| *F01M 11/02* | (2006.01) |

(52) U.S. Cl. ..... 440/88 L; 440/88 R; 440/38; 123/196 R

(58) Field of Classification Search ..... 440/38–43, 440/88 R, 88 L, 88 C, 88 D, 88 G, 88 J, 88 M, 440/89 R, 89 A, 89 B, 89 C, 89 E, 89 G, 440/89 J See application file for complete search history.

(56) References Cited

U.S. PATENT DOCUMENTS

| | | | |
|---|---|---|---|
| 2,434,700 | A | 1/1948 | Keckley |
| 3,043,260 | A | 7/1962 | Tank |
| 3,262,413 | A | 7/1966 | Douglas et al. |
| 3,292,373 | A | 12/1966 | Tado |
| 3,324,822 | A | 6/1967 | Carter, III |
| 3,369,518 | A | 2/1968 | Jacobson |
| 3,408,976 | A | 11/1968 | Ellis |
| 3,426,724 | A | 2/1969 | Jacobson |
| 3,463,116 | A | 8/1969 | Dawson |
| 3,481,303 | A | 12/1969 | Tate et al. |
| 3,548,778 | A | 12/1970 | Von-Smagala-Romanoff |
| 3,608,512 | A | 9/1971 | Thompson |
| 3,869,775 | A | 3/1975 | Smith |

(Continued)

FOREIGN PATENT DOCUMENTS

| | | |
|---|---|---|
| FR | 2617793 | 2/1989 |

(Continued)

OTHER PUBLICATIONS

English language abstract for JP 04-179811.

(Continued)

*Primary Examiner*—Lars A Olson
*Assistant Examiner*—Daniel V Venne
(74) *Attorney, Agent, or Firm*—Dykema Gossett PLLC

(57) ABSTRACT

A system for driving a water induction and discharge system of a watercraft propelled by a water jet includes a water impeller, an engine including a driven shaft and a first chamber for containing engine oil, a second chamber for containing engine oil, a pinion secured to the driven shaft and located in the second chamber, a gear located in the second chamber, engaged with the pinion and driveably connected to the water impeller, and a dam located in the second chamber for limiting oil flow across the dam into the oil contained in the second chamber.

19 Claims, 4 Drawing Sheets

U.S. PATENT DOCUMENTS

| | | | | |
|---|---|---|---|---|
| 3,882,815 | A | 5/1975 | Bennett | |
| 4,020,782 | A | 5/1977 | Gleason | |
| 4,047,494 | A | 9/1977 | Scott | |
| 4,229,850 | A | 10/1980 | Arcouette | |
| 4,237,812 | A | 12/1980 | Richardson | |
| 4,274,357 | A | 6/1981 | Dawson | |
| 4,321,048 | A | 3/1982 | Marchese et al. | |
| 4,457,724 | A | 7/1984 | Miyamoto | |
| D276,994 | S | 1/1985 | Montgomery et al. | |
| 4,497,631 | A | 2/1985 | Belanger | |
| 4,538,996 | A | 9/1985 | Inwood | |
| 4,589,365 | A | 5/1986 | Masters | |
| 4,765,075 | A | 8/1988 | Nakase et al. | |
| 4,781,141 | A | 11/1988 | Webb et al. | |
| 4,942,838 | A | 7/1990 | Boyer et al. | |
| 5,017,166 | A | 5/1991 | Chang | |
| 5,096,446 | A | 3/1992 | Tazaki et al. | |
| 5,209,683 | A | 5/1993 | Imaeda et al. | |
| 5,254,024 | A | 10/1993 | Kobayashi et al. | |
| 5,481,997 | A | 1/1996 | Arndt | |
| 5,582,529 | A | 12/1996 | Montgomery | |
| 5,628,269 | A | 5/1997 | Henmi et al. | |
| 6,033,272 | A | 3/2000 | Whiteside | |
| 6,533,624 | B1 * | 3/2003 | Hattori et al. | 440/88 R |
| 7,040,454 | B2 * | 5/2006 | Kawamoto et al. | 184/106 |

FOREIGN PATENT DOCUMENTS

| | | |
|---|---|---|
| GB | 947655 | 1/1964 |
| GB | 2071206 | 9/1981 |
| JP | 1148694 | 5/1989 |
| JP | 3295791 | 1/1991 |
| JP | 04-179811 | 6/1992 |
| JP | 04-265406 | 9/1992 |

OTHER PUBLICATIONS

English language machine translation of FR2617793 obtained from European Patent Office website (www.espacenet.com).

English language abstract for JP 1148694 obtained from European Patent Office website (www.espacenet.com).

English language abstract for JP 3295791 obtained from European Patent Office website (www.espacenet.com).

Communication Relating to the Results of the Partial International Search issued in corresponding application PCT/US2008/081523 (Apr. 7, 2009).

English language abstract for JP 04-265406.

English language abstract for JP 3295791obtained from European Patent Office website (www.espacenet.com).

International Search Report issued in corresponding International (PCT) Application PCT/US/2008/081523 (Jul. 10, 2009).

Written Opinion issued in corresponding International (PCT) Application PCT/US/2008/081523 (Jul. 10, 2009).

* cited by examiner

ENGINE FOR DRIVING A WATERCRAFT PROPELLED BY A WATER JET

BACKGROUND OF THE INVENTION

1. Field of the Invention

This invention relates generally to a watercraft propelled by a water jet, and in particular, to an internal combustion engine for driving the propulsion system of such a watercraft.

2. Description of the Prior Art

A jet-boat is a boat propelled by a jet of water ejected from the back of the craft. Unlike a powerboat or motorboat that uses a propeller in the water behind the boat, a jet-boat draws the water from under the boat into a pump-jet inside the boat, then expels the injected water through a nozzle at the stern.

Jet-boats are steered and maneuvered by directing the nozzle and water jet laterally from the axis of longitudinal direction, whereby the jet both propels and steers the craft. Jet boats can be reversed and brought to a stop within a short distance from full speed using the jet.

A conventional screw impeller accelerates a large volume of water by a small amount, similar to the way an airplane's propeller accelerates a large volume of air by a small amount. In a jet-boat, pumping a small volume of water, accelerating it by a large amount, and expelling the water above or below the water line delivers thrust that propels the craft. Acceleration of the water is achieved by the impeller driven by a small internal combustion engine (ICE) onboard the craft.

SUMMARY OF THE INVENTION

The engine includes a crank shaft, a first chamber for containing engine oil and, a second chamber for containing engine oil, a gear secured to the crankshaft, and a mating gear secured to an output shaft connected to the water impeller though a coupling. A dam, located in the second chamber, limits oil flow across the dam into the oil contained in the second chamber, The oil flows from the first chamber to the second chamber through an orifice, providing lubrication to the gear set in the second chamber. The rotating gear brings the oil in the lower portion of second chamber into the higher position behind the dam. The orifice limits the amount of oil flow from the first chamber to the second chamber. As the gear rotates, it carries the oil from the lower portion of second chamber to the higher portion of the second chamber behind the dam so that the gear is not submerged in oil.

The dam prevents oil from flowing back from the higher portion to the lower portion in the second chamber. Another orifice permits engine oil, located behind the dam, to flow back to the first chamber. The dam and orifice operate to keep the gear lubricated without being submerged in oil, and maintain an optimum height of the oil level for lubricating the gear properly. Lubrication protection is not at its best when gears are submerged in oil.

The correct level of oil in the second chamber, provided by the orifices and dam, also limits energy losses due to hydraulic drag on the gear as it rotates in the oil compared to the drag loss that would otherwise occur if the oil level were high in the second chamber. Hydraulic drag on the gear increases the magnitude of external load on the engine, potentially reduces the operating efficiency of the engine.

The system also provides a continuous supply of lubricant to the pinion, bear, shafts and bearings. As the gear rotates, oil in the second chamber is thrown radial outward in a mist onto the surfaces of the pinion and gear. An orifice, formed through wall 56, is sized to permit engine oil to flow at an acceptable rate from the first chamber into the second chamber 76, thereby replenishing oil that has been carried away as the pinion rotates through the oil in the second chamber.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DESCRIPTION OF THE DRAWINGS

The invention will be more readily understood by reference to the following description, taken with the accompanying drawings, in which.

DESCRIPTION OF THE PREFERRED EMBODIMENT

Figure 1:
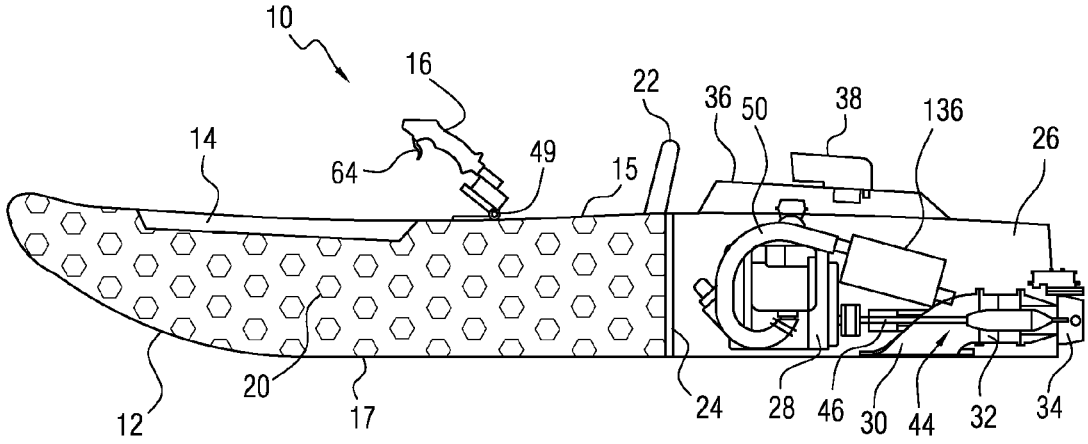
FIG. 1 is a cross-sectional side view of an engine-powered kayak showing the water induction system and engine.

Referring now to FIG. 1, a kayak 10 includes a sealed hull portion 12 covered with a seamless molded plastic skin, the hull being formed with a recess 14 on its upper surface 15, in which recess the rider sits facing forward with legs straddling a manually-operated control lever 16 (called a joystick) and feet supported on foot rests. The volume of hull 12 between its upper deck 15 and its bottom surface 17 is filled with a core material 20 that reinforces, strengthens and stiffens the hull. The core 20 may be expandable, cellular molded foam or a hollow, hexangular honeycomb whose walls are of Kevlar or a similar synthetic material. Alternatively, the core may be machined foam. The hull portion 12 is sealed, thereby preventing entry of water from waves or spray and making it possible to roll the kayak upright again following a tip over without it filling with water.

A seat back 22, secured to the upper surface of the hull 12 supports the seated rider. The core-reinforced portion of the hull 12 is closed by a partition or bulkhead 24, located at the forward end of an engine compartment 26, which contains an engine 28, water intake duct 30, bladed impeller 32 that forces water from the intake duct, and a nozzle 34, whose angular position about a vertical axis can be varied leftward and rightward to steer the kayak 10. Water inducted through duct 30 flows through the impeller and exits through the nozzle 34. The engine compartment 26 is covered with a cowling 36 formed with an air inlet passageway 38. Cowling 36 is secured by latches to the upper surface of the hull, thereby sealing the engine compartment against entry of water when the cowling is latched to the hull. Preferably, engine 28 has a single cylinder and piston, low displacement and operates at high efficiency on a four stroke cycle.

The intake duct 30, which may be a component separate from the hull 12 or formed integrally with the hull, is of molded plastic having an intake opening 44 in the bottom of the hull, through which water is inducted and flows toward the outlet of nozzle 34. A driveshaft 46, secured to the crankshaft of engine 28 drives the bladed impeller 32 in rotation, thereby drawing water into the intake duct 30 and forcing it through the impeller and out the nozzle 34. A water jet, which propels and steers the kayak 10, rises from the outlet of nozzle 34 into the air above the water surface.

The rider pivots the joystick 16 leftward and rightward about an axis to steer the craft 10. The joystick 16 carries a button, which is depressed to start engine 28, a button that stops the engine, and an engine throttle in the form of a trigger 64 located on the underside of the joystick, by which the engine throttle is opened and closed to control engine speed and speed of the kayak 10.

The rider also pivots the joystick 16 upward and downward about axis 49 to locate its hand grip in a comfortable position during use and in a downward position when the craft 10 is stored or being transported. As the joystick 16 pivots, cables supported on pulleys transmit movement of the joystick to the nozzle 34, thereby steering and maneuvering the kayak leftward and rightward by redirecting the water jet exiting the nozzle relative to the longitudinal axis of the craft.

Figure 2:
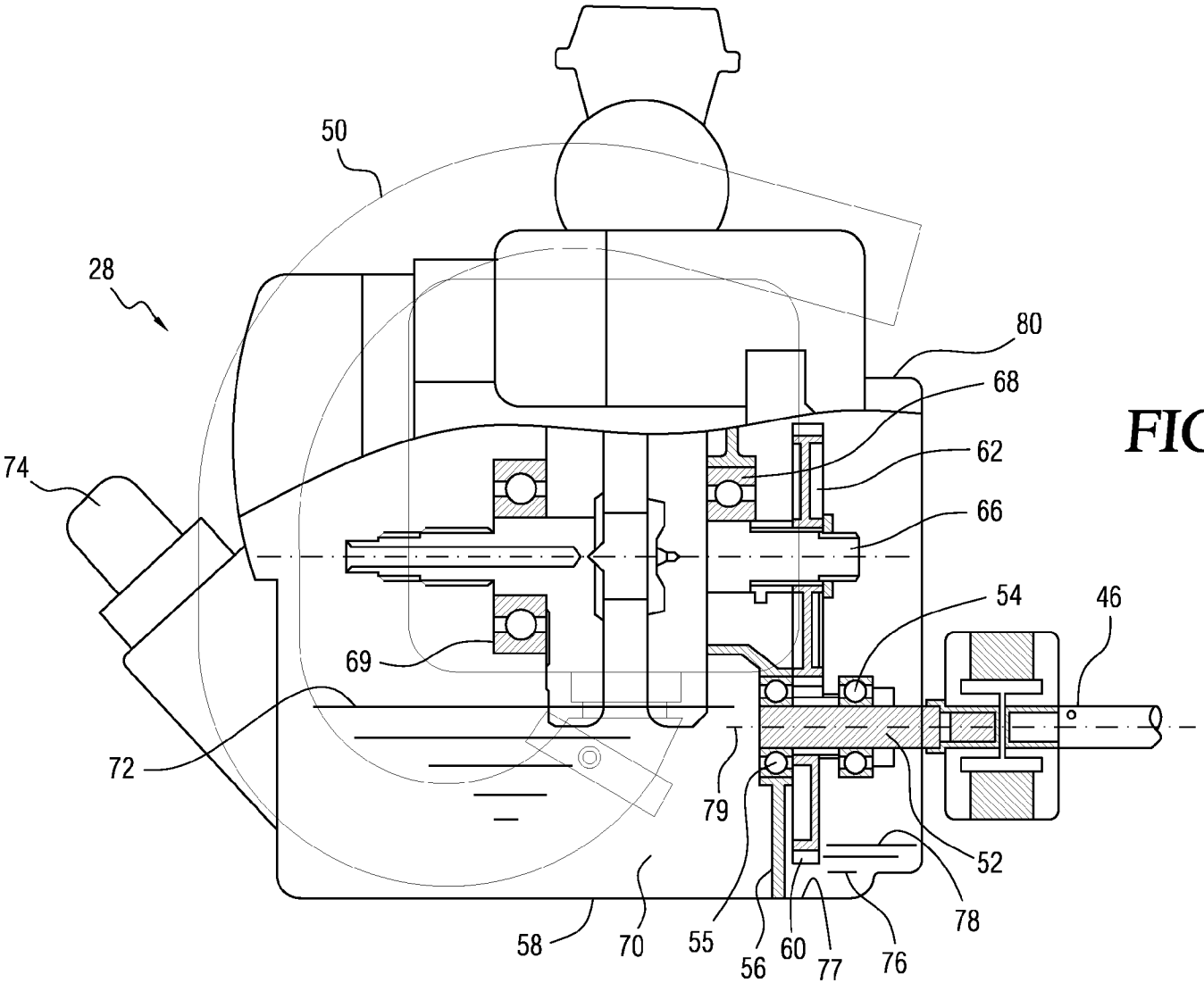
FIG. 2 is partial cross section side view of the engine and water induction system shown in FIG. 1.

FIG. 2 shows that the exhaust system for engine 28 includes an exhaust pipe 50, which carries exhaust gas from the engine in a path that is directed upward and then downward to prevent water from entering the engine.

The output shaft 52 of engine 28 is supported by anti-friction bearings 54, 55 on a wall 56 formed in the engine casing 58. Shaft 52 is secured to driveshaft 46 of the water intake and discharge system. Output shaft 52 is secured to an output gear 60, which is in continuous meshing engagement with a pinion gear 62, supported on the engine crankshaft 66. Bearing 68, fitted in the wall 56 of the engine casing 58, and bearing 69 support crankshaft 66.

Engine casing 58 is formed with a first oil chamber 70, which normally contains engine lubricating oil at about level 72. A dipstick 74, threaded into an exterior wall of casing 58, can be removed to visually check the level of oil in the first oil chamber 70. Wall 56 separates the first chamber 70 from a second oil chamber 76 having a first surface 77 that supports engine oil contained in the second chamber. Normally the upper surface of the engine oil in chamber 76 is at level 78. Gear 60 and pinion 62 are located in chamber 76, and the teeth of gear 60 rotate through the oil in chamber 76 as gear 60 is driven by pinion 62 in rotation about axis 79.

Figure 3:
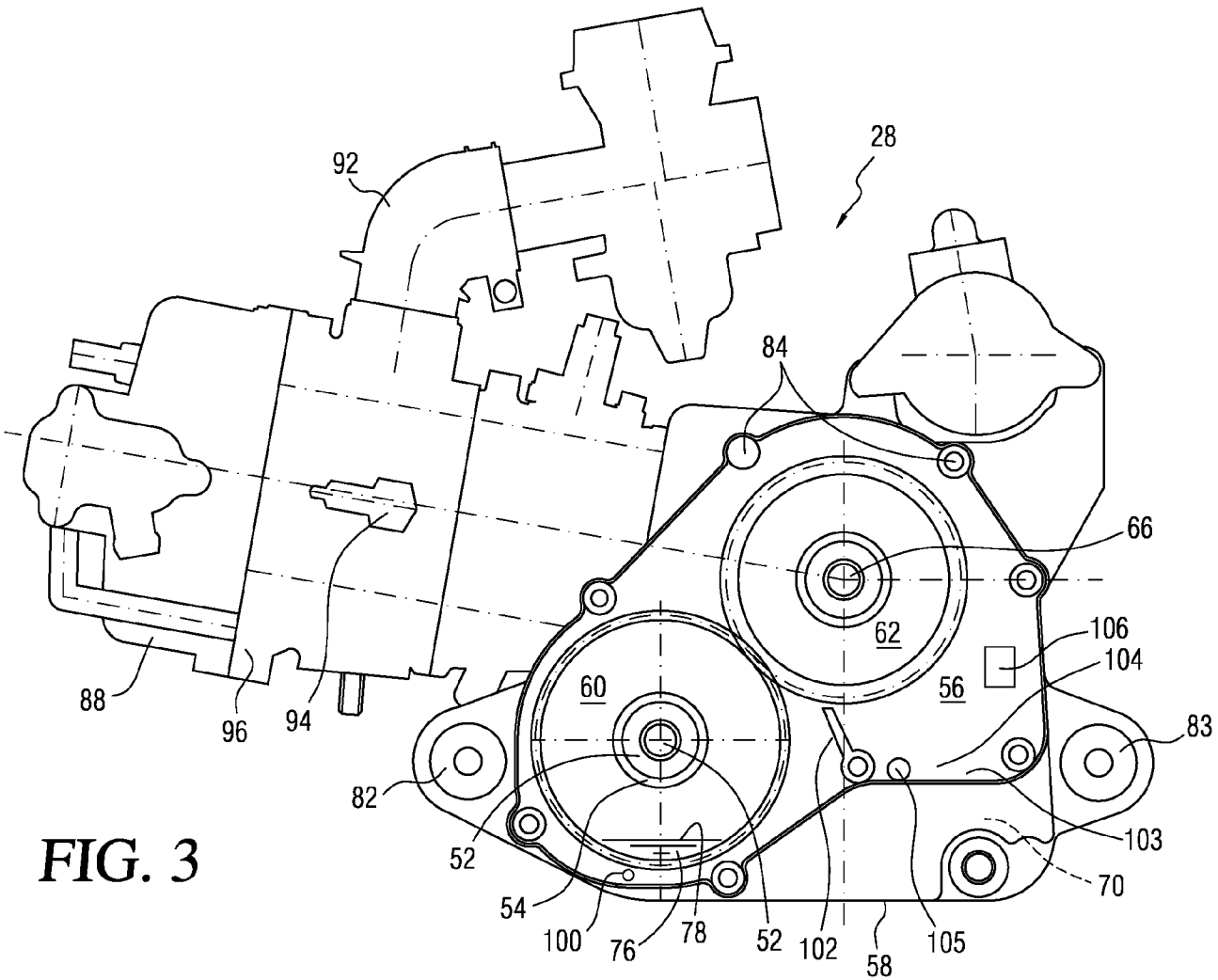
FIG. 3 is an end view of the engine view of the engine shown in FIG. 1.

FIG. 3 shows the wall 56 of engine 28 with the cover 80 removed. The engine is supported on the kayak 10 at engine mounts 82, 83, and cover 80 is secured to the engine casing 58 at a series of bolt holes 84 spaced about the periphery of cover 80, which is shown in-place in FIG. 2. A valve cover 88 is secured to the top of a combustion cylinder 96 supplied with air through cowling 36 and duct 92. A spark plug 94 is fitted on the wall of the combustion cylinder 96, in which a piston (not shown) reciprocates and drives shaft 66 in rotation.

As gear 60 rotates, oil in chamber 76 is thrown radial outward in a fine mist against the inside of cover 80, onto the surfaces of pinion 62 and gear 60, and against wall 56. An orifice 100, formed through wall 56, is sized to permit engine oil to flow at an acceptable rate from chamber 70 into chamber 76, thereby replenishing oil in chamber 76 that has been carried away as pinion 60 rotates through the oil in chamber 76.

A partition or dam 102, supported on wall 56, is located in second chamber 76 on a second surface 103 that is located above the surface 78 of oil contained in chamber 76. Dam 102 limits oil, which may collect in a space 104 behind the dam and at the outboard side of wall 56, from flowing from surface 103 into the oil contained in chamber 76 and above surface 78. An orifice 105 formed through wall 56 permits engine oil in space 104 to flow through wall 56 into chamber 70. Dam 102 and orifice 105 operate to limit the height of the oil level 78 contained in chamber 76, thereby providing the best lubrication protection. Lubrication protection is not at its best when gears are submerged in oil. Hydraulic drag on gear 60 increases the magnitude of external load on engine 28 and potentially reduces the operating efficiency of the engine.

A window 106 formed in wall 56 provides a passageway to circulate any oil mist between chambers 70 and 76.

Figure 4:
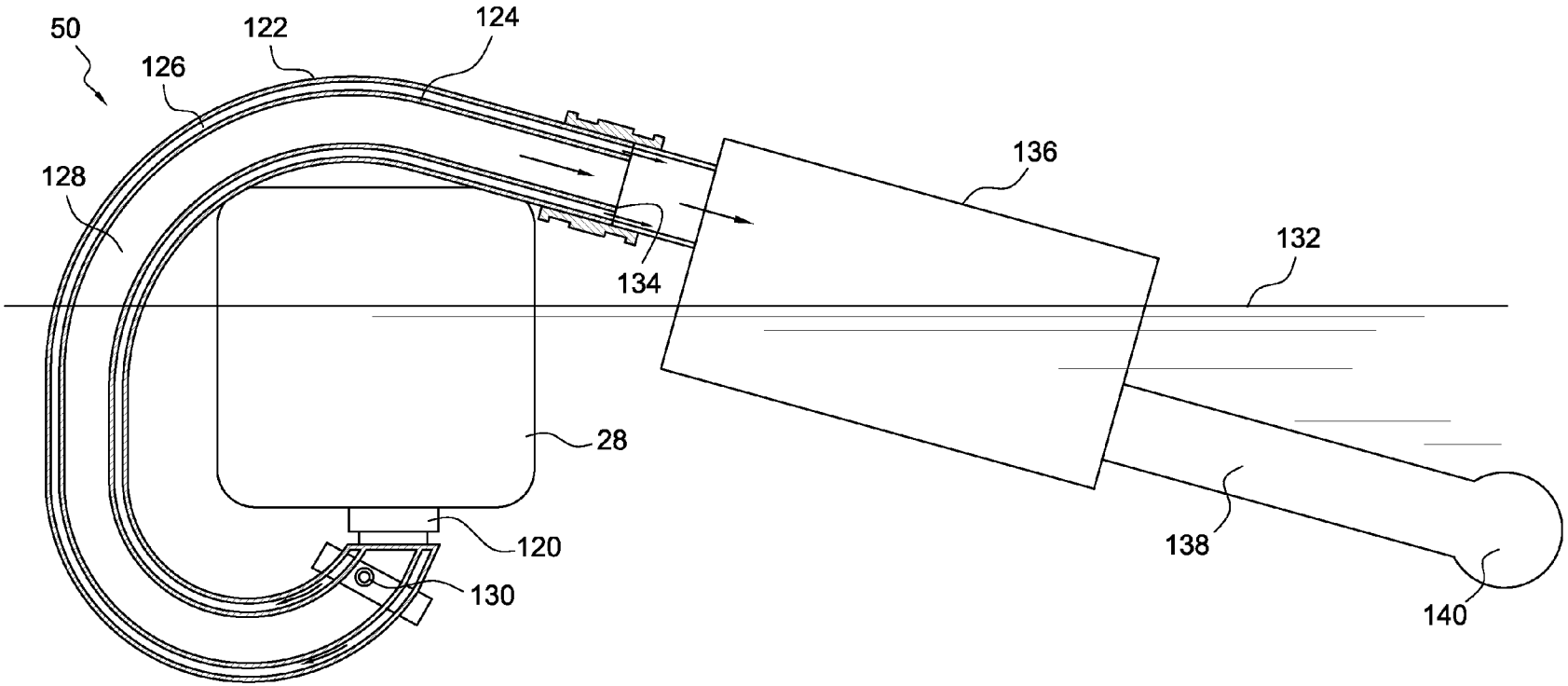
FIG. 4 is a side view, partially in cross section, of the engine exhaust gas system.

FIG. 4 illustrates details of the exhaust system of the engine 28 for preventing water from entering the engine. The exhaust pipe 50, which is secured at one end to an exhaust port 120 of the engine 28, is in the form of a double walled tube that includes an outer tube 122, an inner tube 124, an annular passage 126 between the tubes 122, 124, and an inner passage 128. The annular passage is closed at its end nearest the exhaust port 1 20. The annular passage 1 26 carries water, which enters passage 126 from a water body, preferably the lake or stream in which the watercraft 1 0 is operating, through an orifice 1 30, which is located below the waterline 132 of the watercraft. Engine exhaust gas enters passage 128 from port 120 and is pumped by the engine to the opposite end 134 of tubes 122 and 124. There, the exhaust gas produces a high speed gas jet exiting passage 128. The gas jet operates to draw water from annular water passage 126. The water and exhaust gas combine into a mixed stream that flows into a water box 136, which is partially submerged below the waterline 132. Water and engine exhaust gas are pumped by the engine exhaust from the water box 136 through a pipe 138 having an opening 140, through which the water and exhaust gas exit the system and flow into the water body.

The water flowing in annular passage 126 cools the tube 122 and provides a low temperature water jacket around the inner exhaust gas tube 124. The exhaust pipe 50 is directed upward from outlet port 120 above the waterline 132, and then downward below the waterline down. This upward and downward path blocks water from entering the engine exhaust port 120 and cylinder head.

In accordance with the provisions of the patent statutes, the preferred embodiment has been described. However, it should be noted that the alternate embodiments can be practiced otherwise than as specifically illustrated and described.

What is claimed is:

1. A system for driving a water induction and discharge system of a watercraft propelled by a water jet comprising:

a bladed impeller for pumping water through the induction and discharge system;

an engine including a casing formed with a wall that at least partially encloses a first chamber for containing engine oil and a second chamber located on an opposite side of the wall from the first chamber and including a first surface and a second surface at a higher elevation than the first surface;

a pinion located in the second chamber and driveably connected to a shaft driven by the engine;

a gear located in the second chamber, engaged with the pinion and driveably connected to the water impeller; and a dam located in the second chamber for limiting oil flow from the second surface to the first surface.

2. The system of claim 1 further including:

a first aperture interconnecting the first chamber and the second chamber.

3. The system of claim 1 further including:

a second aperture interconnecting the first chamber and a space behind the dam in the second chamber.

4. The system of claim 1 further including:

a window formed in the wall and interconnecting the first chamber and the second chamber.

5. The system of claim 1 further including a cover secured to the casing for closing the second chamber.

6. The system of claim 1 wherein the shaft driven by the engine extends through the wall into the second chamber and is are located at a higher elevation than the gear.

7. The system of claim 1 further comprising an engine exhaust system that includes:

an exhaust pipe defining a first passage communicating with an exhaust port of the engine, a second passage surrounded by and substantially parallel to the first passage and communicating with a source of water;

a water box communicating with the first and second passages and the source of water; and a gas jet that draws water from the second passage into the water box.

8. A system for driving a water induction and discharge system of a watercraft propelled by a water jet comprising:

a bladed water impeller;

an engine including a driven shaft and a first chamber for containing engine oil;

a second chamber including a first surface and a second surface at a higher elevation than the first surface;

a wall separating the first chamber from the second chamber;

a pinion secured to the driven shaft and located in the second chamber;

a gear located in the second chamber, engaged with the pinion and driveably connected to the water impeller; and a dam located in the second chamber for limiting oil flow across the dam.

9. The system of claim 8 further including:

a first aperture interconnecting the first chamber and the second chamber.

10. The system of claim 8 further including:

a second aperture interconnecting the first chamber and a space behind the dam in the second chamber.

11. The system of claim 8 further including:

a window formed in the wall and interconnecting the first chamber and the second chamber.

12. The system of claim 8 wherein the driven shaft extends through the wall into the second chamber and is are located at a higher elevation than the gear.

13. The system of claim 8 further comprising an engine exhaust system that includes:

an exhaust pipe defining a first passage communicating with an exhaust port of the engine, a second passage surrounded by and substantially parallel to the first passage and communicating with a source of water;

a water box communicating with the first and second passages and the source of water; and a gas jet that draws water from the second passage into the water box.

14. A system for driving a water induction and discharge system of a watercraft propelled by a water jet comprising:

a bladed water impeller;

an engine including a driven shaft and a first chamber for containing engine oil;

a second chamber for containing engine oil;

a pinion secured to the driven shaft and located in the second chamber;

a gear located in the second chamber, engaged with the pinion and driveably connected to the water impeller; and a dam located in the second chamber for limiting oil flow across the dam into the oil contained in the second chamber.

15. The system of claim 14 further including:

a first aperture interconnecting the first chamber and the second chamber.

16. The system of claim 14 further including:

a second aperture interconnecting the first chamber and a space behind the dam in the second chamber.

17. The system of claim 14 further including:

a window formed in the wall and interconnecting the first chamber and the second chamber.

18. The system of claim 14 wherein the shaft driven by the engine extends into the second chamber and is are located at a higher elevation than the gear.

19. The system of claim 14 further comprising an engine exhaust system that includes:

an exhaust pipe defining a first passage communicating with an exhaust port of the engine, a second passage surrounded by and substantially parallel to the first passage and communicating with a source of water;

a water box communicating with the first and second passages and the source of water; and p1 a gas jet that draws water from the second passage into the water box.

* * * * *

UNITED STATES PATENT AND TRADEMARK OFFICE

CERTIFICATE OF CORRECTION

PATENT NO. : 7,597,600 B2
APPLICATION NO. : 11/933751
DATED : October 6, 2009
INVENTOR(S) : Yuting Rui It is certified that error appears in the above-identified patent and that said Letters Patent is hereby corrected as shown below:

Col. 6, line 42, please delete "p1"

Signed and Sealed this

Twenty-fourth Day of November, 2009

David J. Kappos

David J. Kappos
*Director of the United States Patent and Trademark Office*